US006541764B2

(12) United States Patent
Ohkawa

(10) Patent No.: US 6,541,764 B2
(45) Date of Patent: Apr. 1, 2003

(54) HELICALLY SYMMETRIC PLASMA MASS FILTER

(75) Inventor: Tihiro Ohkawa, La Jolla, CA (US)

(73) Assignee: Archimedes Technology Group, Inc., San Diego, CA (US)

( * ) Notice: Subject to any disclaimer, the term of this patent is extended or adjusted under 35 U.S.C. 154(b) by 196 days.

(21) Appl. No.: 09/814,082

(22) Filed: Mar. 21, 2001

(65) Prior Publication Data

US 2002/0134708 A1 Sep. 26, 2002

(51) Int. Cl.[7] ..... B03C 1/00
(52) U.S. Cl. ..... 250/281; 210/695
(58) Field of Search ..... 250/281, 290, 250/291, 298; 210/695

(56) References Cited

U.S. PATENT DOCUMENTS 3,722,677 A 3/1973 Lehnert
5,039,312 A 8/1991 Hollis
5,868,909 A 2/1999 Eastlund
6,096,220 A * 8/2000 Ohkawa ..... 210/695
6,214,223 B1 4/2001 Ohkawa
6,251,282 B1 * 6/2001 Putvinski et al. ..... 210/695

* cited by examiner

*Primary Examiner*—John R. Lee
*Assistant Examiner*—Christopher Kalivoda
(74) *Attorney, Agent, or Firm*—Nydegger & Associates

(57) ABSTRACT

A plasma mass filter for separating low-mass particles from high-mass particles in a multi-species plasma includes a substantially cylindrically shaped barrier surrounding a chamber and defining a longitudinal axis. Helically shaped coils are mounted on the barrier to establish a magnetic field in the chamber. Conducting rings are provided to establish a radially directed electric field in the chamber. The plasma is injected into the chamber for interaction with the electric and magnetic fields, placing the high-mass particles onto trajectories rotating about a guiding center that travels within a surface having a hyperbolic shape. The low-mass particles are placed onto trajectories rotating about a guiding center that travels within a surface having an elliptical shape. The fields create an axial force directing the particles away from the injection point. As such, the high-mass particles strike the inner wall of the barrier, while the low-mass particles transit through the chamber.

22 Claims, 2 Drawing Sheets

HELICALLY SYMMETRIC PLASMA MASS FILTER

FIELD OF THE INVENTION

The present invention pertains generally to devices and methods for separating charged particles in a plasma according to their respective masses. More particularly, the present invention pertains to devices for placing low-mass and high-mass particles on different, predictable trajectories to thereby separate the particles according to their respective masses. The present invention is particularly, but not exclusively, useful as a filter to separate high-mass particles from low-mass particles.

BACKGROUND OF THE INVENTION

There are many reasons why it may be desirable to separate or segregate mixed materials from each other. One such application where it may be desirable to separate mixed materials is in the treatment and disposal of hazardous waste. For example, it is well known that of the entire volume of nuclear waste, only a small amount of the waste consists of radionuclides that cause the waste to be radioactive. Thus, if the radionuclides can somehow be segregated from the non-radioactive ingredients of the nuclear waste, the handling and disposal of the radioactive components can be greatly simplified and the associated costs reduced.

Indeed, many different types of devices, which rely on different physical phenomena, have been proposed to separate mixed materials. For example, settling tanks which rely on gravitational forces to remove suspended particles from a solution and thereby segregate the particles are well known and are commonly used in many applications. As another example, centrifuges which rely on centrifugal forces to separate substances of different densities are also well known and widely used. In addition to these more commonly known methods and devices for separating materials from each other, there are also devices which are specifically designed to handle special materials. A plasma centrifuge is an example of such a device.

As is well known, a plasma centrifuge is a device which generates centrifugal forces to separate charged particles in a plasma from each other. For its operation, a plasma centrifuge necessarily establishes a rotational motion for the plasma about a central axis. A plasma centrifuge also relies on the fact that charged particles (ions) in the plasma will collide with each other during this rotation. The result of these collisions is that the relatively high-mass ions in the plasma will tend to collect at the periphery of the centrifuge. On the other hand, these collisions will generally exclude the lower mass ions from the peripheral area of the centrifuge. The consequent separation of high-mass ions from the relatively lower mass ions during the operation of a plasma centrifuge, however, may not be as complete as is operationally desired, or required.

Apart from a centrifuge operation, it is well known that the orbital motions of charged particles (ions) which have the same velocity in a magnetic field, or in crossed electric and magnetic fields, will differ from each other according to their respective masses. Thus, when the probability of ion collision is significantly reduced, the possibility for improved separation of the particles due to their orbital mechanics is increased. For example, U.S. Pat. No. 6,096,220, which issued on Aug. 1, 2000 to Ohkawa, for an invention entitled "Plasma Mass Filter" and which is assigned to the same assignee as the present invention, discloses a device which relies on the different, predictable, orbital motions of charged particles in crossed electric and magnetic fields to separate the charged particles from each other. In the filter disclosed in Ohkawa '220, the magnetic field is oriented axially, the electric field is oriented radially, and both the magnetic field and the electric field are substantially uniform both azimuthally and axially. As further disclosed in Ohkawa '220, this configuration of fields causes ions having relatively small mass to charge ratios to be confined inside the chamber during their transit of the chamber. On the other hand, ions having relatively large mass to charge ratios are not so confined. Instead, these larger mass ions are collected inside the chamber before completing their transit through the chamber.

Expanding on the general principles previously disclosed in the Ohkawa '220 patent for separating ions of different mass, the present invention has recognized that by appropriately modifying the electric and magnetic fields in the filter chamber, the effective magnetic field strength can be reduced. Further, a unidirectional axial velocity can be imparted on the particles, helping the light mass particles transit through the chamber, and preventing buildup of waste on the injection end plate. Specifically, the filter concept disclosed in the Ohkawa '220 patent can be generalized to the case where the fields are helically symmetric. More specifically, helical symmetry includes the case of azimuthally symmetric but axially bumpy fields as a special case.

Consider the Hamiltonian, H of a charged particle in the magnetic and electric fields.

$$H=p_r^2/2M+[p_\Theta-erA_\Theta]^2/[2Mr^2]+[p_z-eA_z]^2/[2M]+e\Phi \quad [1]$$

where p is the canonical momentum, M is the mass, A is the vector potential, Φ is the electrostatic potential, and e is the charge. In the helically symmetric configurations, both the vector potential and the electrostatic potential are functions of ϕ defined by $$\phi=m\theta+kz. \quad [2]$$

where θ is the angle around the cylindrical axis and m is the azimuthal mode number, while z is the coordinate along the cylinder and k is the axial mode number.

From the Hamiltonian, the following expression can be obtained $$d/dt[kp_\Theta-mp_z]=0. \quad [3]$$

Thus, the helical canonical momentum $p_h$=k $p_\Theta$−m $p_z$ is a constant of motion.

A new Hamiltonian, K can be defined by $$K=H+up_h \quad [4]$$

where u is a constant having the dimensions of the velocity. The expression $$K=p_r^2/2M+[p_\Theta+ukMr^2-erA_\Theta]^2/[2Mr^2]+[p_z-umM-eA_z]^2+U \quad [5]$$

follows, where $$U=-Mu^2[m^2+k^2r^2]/2-eu\psi_h+e\Phi \quad [6]$$

and $$\psi_h=mA_z-krA_\Theta \quad [7]$$

The helical flux function $\psi_h$ defines the flux surface.

The second and the third terms represent the kinetic energy in the coordinates that rotates at the angular frequency, −ku and travels in the axial direction at the velocity, mu. The potential, U determines the orbit confining properties. The first term in U is the centrifugal term, the second term is the magnetic confinement term and the last term is the electrostatic driving term. It has the form similar to the filter disclosed in the Ohkawa '220 patent. The difference is that the vector potential of the uniform magnetic field is replaced by the helical flux function.

The magnetic field with uniform axial magnetic field, $B_0$ superposed with the field from the helical windings is given by $$B_r=-ibI_m'[kr]\exp[im\theta+ikz]$$
$$B_\theta=[b/kr]I_m\exp[im\theta+ikz] \quad [8]$$
$$B_z=bI_m\exp[im\theta+ikz]+B_0$$

where $I_m$ is the modified Bessel function, the prime denotes the derivative and b represents the strength of the helical field. $B_0$ is chosen to be larger than b.

The helical flux function is given by $$\psi_h=-[k\ r^2/2]B_0-brI_m'[kr]\exp[im\theta+ikz] \quad [9]$$

Among the choices of m number, only m=0 and m=2 have $r^2$ dependence near the axis. As far as the cut-off mass is concerned, the conditions are identical for m=2 and m=0. Thus $$\psi_h=-[kr^2/2][B_0+b\cos[2\theta+kz]] \quad [10]$$

and putting $$\Phi=[\alpha/k]\psi_h \quad [11]$$

the expression $$U=-[Mr^2/2]\{k^2u^2-[ku-\alpha][\Omega_0+\Omega_h\cos[2\theta+kz]]\} \quad [12]$$

can be obtained, where $\Omega_0=eB_0/M$ and $\Omega_h=eb/M$.

The constant U surface, namely the guiding center surface, is either an ellipse or a hyperbola. The cut-off mass is defined as the mass above which the constant U surface becomes a hyperbola. The condition is given by $$\alpha>[\Omega_0-\Omega_h]/4 \quad [13]$$

The difference from the filter disclosed in the Ohkawa '220 patent is that the helical field reduces the effective magnetic field strength. Also, the plasma not only rotates, but also has a unidirectional axial velocity resulting from the radial electric field crossed with the "theta" component of b. The cut-off mass, $M_c$ is given by the weakest field of the bumpy field.

Since the magnetic field is non-uniform, there may be the mirror trapped ions. However the constant U surface opens up at the weakest magnetic field and the mirror trapped ions with the mass above cut-off will go out radially.

In the collisional regime, the thermal equilibrium distribution of an ensemble of ions is proportional to $\exp[-K/\kappa T]$. Only the ions with the mass below cut-off will be confined in a finite volume.

In light of the above, it is an object of the present invention to provide a plasma mass filter which has azimuthally symmetric but axially bumpy fields. Another object of the present invention is to provide a plasma mass filter that is operable at a relatively low effective magnetic field strength. Still another object of the present invention is to provide a plasma mass filter which imparts a unidirectional axial velocity on the particles, helping the light mass particles transit through the chamber and reducing buildup on the injection end plate. Yet another object of the present invention is to provide a Helically Symmetric Plasma Mass Filter which is easy to use, relatively simple to manufacture, and comparatively cost effective.

SUMMARY OF THE PREFERRED EMBODIMENTS

The present invention is directed to a plasma mass filter for separating low-mass to charge particles from high-mass to charge particles in a multi-species plasma. For the present invention, the filter includes a substantially cylindrically shaped barrier having a first end and a second end. The barrier is formed with an inner wall and an outer wall, with the inner wall surrounding a chamber and defining a longitudinal axis.

Preferably, four helically shaped coils are mounted on the outer wall to establish a magnetic field in the chamber. Specifically, each helical coil is formed in the shape of a helix to wrap around the outside of the barrier and extend from the first end of the barrier to the second end of the barrier. Further, the four helical coils have a common angle of inclination and preferably are evenly spaced around the circumference of the barrier. Stated another way, at the first end, second end and on every cross section normal to the axis, the four helical coils are equally spaced (i.e. spaced approximately 90 degrees apart).

For the present invention, a current is passed through the helically shaped coils to establish a magnetic field within the chamber. Preferably, the current in two of the helically shaped coils travels in a direction from the first end to the second end while the current in the other two helically shaped coils travels in a direction from the second end to the first end. Specifically, each pair of opposed coils (i.e. coils that are spaced 180 degrees at the ends of the barrier) have currents flowing in the same direction.

In addition to the helically shaped coils, an optional set of coils is provided to superimpose an axial magnetic field having strength, $B_0$, with the field from the helical coils. For this purpose, the optional coils may take the form of annular shaped coils mounted to the outer wall of the barrier. With this combination of structure, a magnetic field can be established inside the chamber having components:

$$B_r=-ibI_m'[kr]\exp[im\theta+ikz]$$
$$B_\theta=[b/kr]I_m\exp[im\theta+ikz]$$
$$B_z=bI_m\exp[im\theta+ikz]+B_0$$

at each location with coordinates {r, θ, z} in the chamber. For the calculation of these magnetic field components, the point having cylindrical coordinates {r, θ, z} equal to {0,0,0} is located on the longitudinal axis, $I_m$ is the modified Bessel function, $I_m'$ is the derivative of the modified Bessel function, b is the strength of the helical field and $B_0$ is the uniform axial magnetic field.

For the present invention, the filter further includes a series of conducting rings concentrically centered on the longitudinal axis and positioned at one end of the chamber. When activated, these rings generate an electric field in the chamber that is oriented substantially in a radial direction between the longitudinal axis and the barrier. Preferably, the rings establish a field in the chamber having a positive potential along the longitudinal axis and a substantially zero potential on the inner wall of the barrier.

In the operation of the present invention, the magnitude of the magnetic field components $B_r$, $B_\theta$, $B_z$, and the magnitude of the positive potential, "$V_{ctr}$", along the longitudinal axis of the chamber are set. Next, a multi-species plasma having both low-mass and high-mass particles is injected into the chamber at the first end of the barrier for interaction with the electric and magnetic fields. In accordance with the mathematics outlined above, for the $B_0>b$ cutoff mass, $M_c$, between high-mass and low-mass particles is given by the expression:

$$M_c=e(B_0(B_0-b))R^2/8V_{ctr}$$

where e is the magnitude of the electron charge, and R is the radius of the wall.

Inside the chamber, the electric and magnetic fields combine to place the high-mass particles (i.e. particles having mass>$M_c$) onto trajectories rotating about a guiding center that travels on a surface having a hyperbolic shape. As such, these high-mass particles are ejected from the chamber for collection at the inner wall of the barrier. To the contrary, the electric and magnetic fields combine to place the low-mass particles (i.e. particles having mass<$M_c$) onto trajectories rotating about a guiding center that travels on a surface having an elliptical shape. As such, these low-mass particles are confined to a finite volume, and accordingly, transit through the chamber, exiting the chamber at the second end of the barrier.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENT

Figure 1:
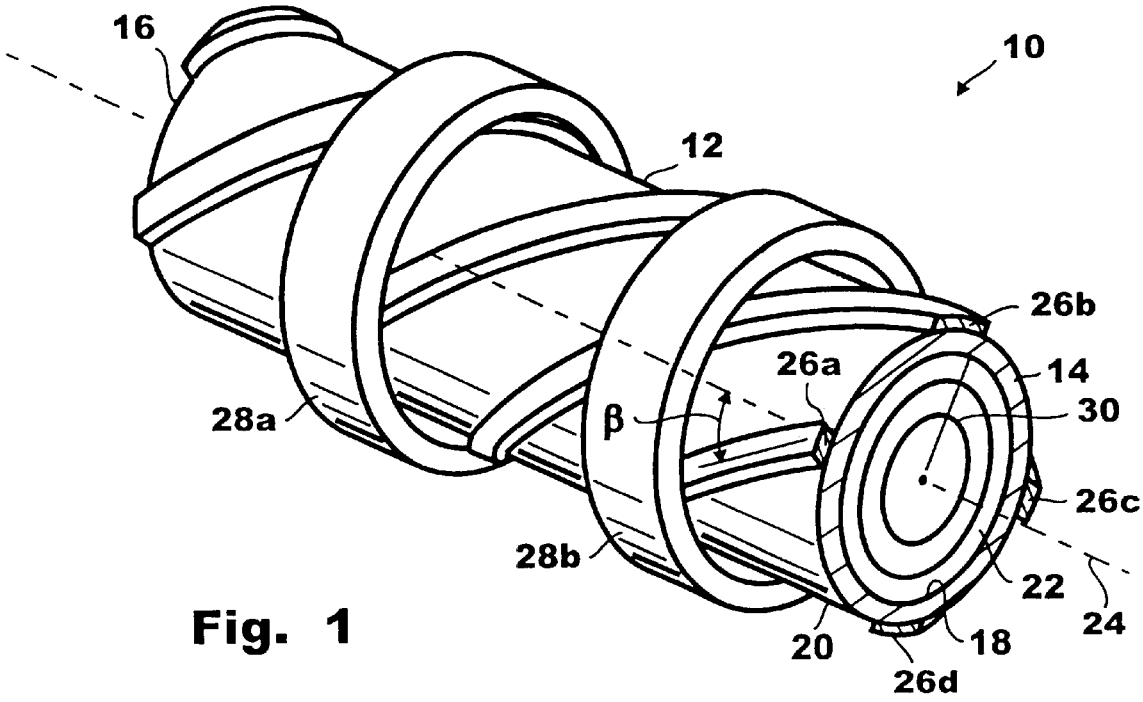
FIG. 1 is a perspective view of a helically symmetric filter in accordance with the present invention.
Figure 2:
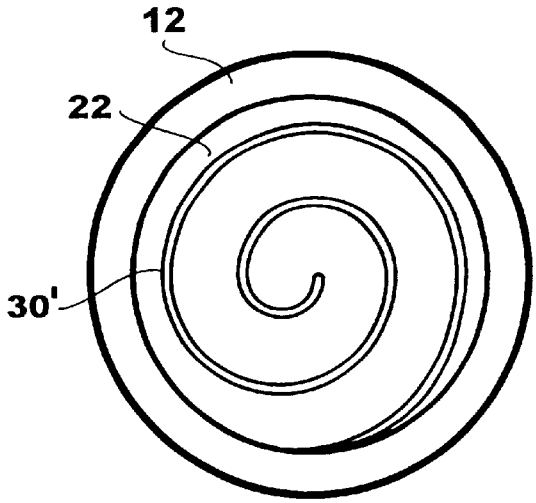
FIG. 2 is an elevational view of a n alternative embodiment of the electrode for creating the radially directed electric field.

Referring to FIG. 1, a helically symmetric plasma mass filter in accordance with the present invention is shown and generally designated 10. As shown in FIG. 2, the filter 10 includes a substantially cylindrically shaped barrier 12 having a first end 14 and a second end 16. The barrier 12 is formed with an inner wall 18 and an outer wall 20, with the inner wall 18 surrounding a chamber 22 and defining a longitudinal axis 24.

Preferably, as shown, four helically shaped coils 26*a–d* are mounted on the outer wall 20 to establish a magnetic field in the chamber 22. Specifically, each helical coil 26 is formed to wrap around the outside of the barrier 12 and extend from the first end 14 of the barrier 12 to the second end 16 of the barrier 12. Further, the four helical coils 26 have a common angle of inclination, β, and are preferably evenly spaced around the circumference of the barrier 12. As such, at the first end 14, the four helical coils 26*a–d* are equally spaced (i.e. spaced approximately 90 degrees apart) around the barrier 12. Although the use of four helically shaped coils 26 is preferred, it is to be appreciated that more or less than four helically shaped coils 26 can be used.

In accordance with the present invention, a current is passed through the helically shaped coils 26*a–d* to establish a magnetic field within the chamber 22. In the preferred embodiment of the present invention, the current in a first pair of helically shaped coils (such as coil pair 26*a* and 26*c*) travels from the first end 14 to the second end 16 while the current in the other pair of helically shaped coils (such as coil pair 26*b* and 26*d*) travels from the second end 16 to the first end 14.

As further shown in FIG. 1, an optional set of coils 28*a–b* can be provided to superimpose an axial magnetic field having strength, $B_0$, with the field from the helical coils 26*a–d*. As shown, the optional coils 28 may be shaped as an annulus and mounted to surround the outer wall 20 of the barrier 12. With this combination of structure, a magnetic field can be established inside the chamber 22 having components:

$$B_r=-ibI_m'[kr]\exp[im\theta+ikz]$$

$$B_\theta=[b/kr]I_m\exp[im\theta+ikz]$$

$$B_z=bI_m\exp[im\theta+ikz]+B_0$$

at each location with coordinates {r, θ, z} in the chamber 22. For the calculation of these magnetic field components, the point having cylindrical coordinates {r, θ, z} equal to {0,0,0} is located on the longitudinal axis 24, $I_m$ is the modified Bessel function, $I_m'$ is the derivative of the modified Bessel function, b is the strength of the helical field and $B_0$ is the uniform axial magnetic field generated by the optional coils 28.

Referring still to FIG. 1, the filter 10 further includes a series of conducting rings 30 mounted at one of the ends 14, 16 of the barrier 12 and concentrically centered on the longitudinal axis 24. When activated, these rings 30 generate an electric field in the chamber 22 that is substantially oriented in a radial direction between the longitudinal axis 24 and the barrier 12. Preferably, the rings 30 establish an electric field in the chamber 22 having a positive potential along the longitudinal axis 24 and a substantially zero potential along the inner wall 18 of the barrier 12. An alternate arrangement for establishing the electric field described above is the spiral electrode 30' shown in FIG. 2.

Figure 3:
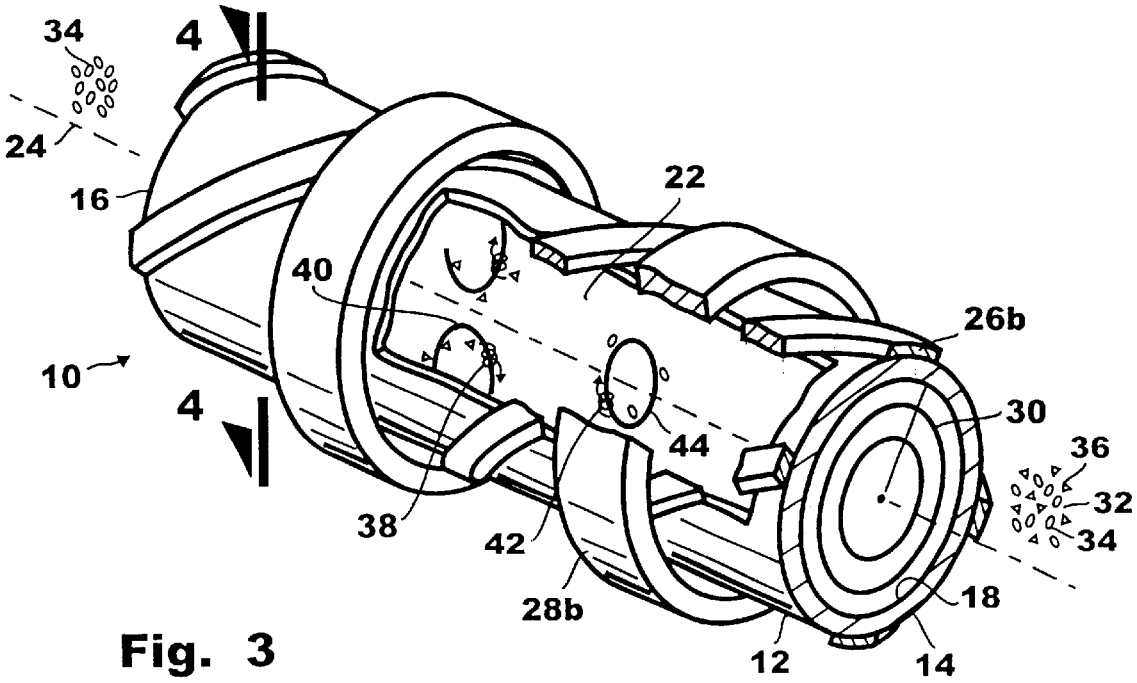
FIG. 3 is a perspective view of a helically symmetric filter in accordance with the present invention with portions broken away for clarity.

Referring now to FIG. 3, in the operation of the filter 10 of the present invention, the magnitude of the magnetic field components, $B_r$, $B_\theta$, $B_z$, and the magnitude of the positive potential, "$V_{ctr}$", along the longitudinal axis 24 of the chamber 22 are set. Next, a multi-species plasma 32 is injected into the chamber 22 at the first end 14 of the barrier 12 for interaction with the electric and magnetic fields. For purposes of disclosure, the multi-species plasma 32 will typically include ions (charged particles) of different mass which can be generally categorized as either low-mass to charge particles 34 or high-mass to charge particles 36. Although the separation depends on mass to charge state, for purposes of this disclosure, the terms low-mass and high-mass are used with the understanding that multiple charged ions will have lower effective mass. In accordance with the mathematics outlined above, for a barrier of radius, R, the cutoff mass, $M_c$, between high-mass particles 36 and low-mass particles 34 is given by the expression:

$$M_c=e(B_0(B_0-b))R^2/8V_{ctr}.$$

Here, e is the magnitude of the electron charge, and the filter 10 is configured with the magnitude of $B_0$ being larger than the magnitude of b.

Figure 4:
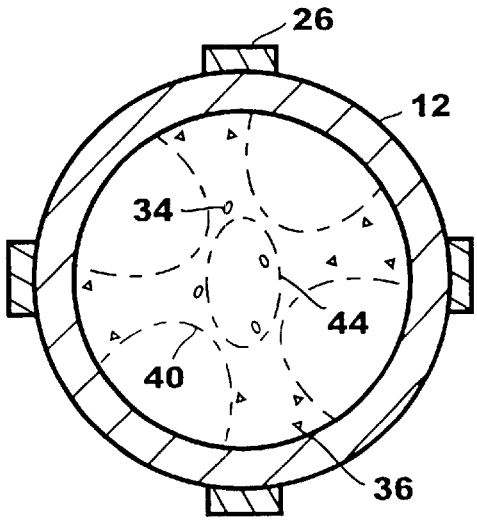
FIG. 4 is a cross-sectional view of the helically symmetric filter as seen along line 4—4 in FIG. 3, showing the guiding center surfaces for high-mass and low-mass particles.

In accordance with the present invention, the electric and magnetic fields combine inside the chamber 22, to place the high-mass particles 36 (i.e. particles having mass>$M_c$) onto trajectories 38 rotating about a guiding center that travels on a surface having a hyperbolic shape. Curve 40 shown in FIGS. 3 and 4 is an exemplary curve residing on such a hyperbolically shaped surface. As such, these high-mass particles 36 are ejected from the chamber 22 for collection at the inner wall 18 of the barrier 12. To the contrary, the electric and magnetic fields combine to place the low-mass particles 34 (i.e. particles having mass<$M_c$) onto trajectories (such as exemplary trajectory 42) rotating about a guiding center that travels on a surface having an elliptical shape. Curve 44 shown in FIGS. 3 and 4 is an exemplary curve residing on such an elliptically shaped surface. As such, these low-mass particles 36 are confined to a finite volume, and accordingly, transit through the chamber 22, exiting the filter 10 at the second end 16.

While the particular helically symmetric plasma mass filter as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A plasma mass filter for separating low-mass particles from high-mass particles in a multi-species plasma, said filter comprising:

a substantially cylindrically shaped barrier having a first end and a second end and formed with an outer wall and an inner wall, said inner wall surrounding a chamber and defining a longitudinal axis;

a plurality of helically shaped coils for establishing a magnetic field in said chamber, each said coil mounted on said outer wall and extending from said first end of said barrier to said second end of said barrier;

a means for generating an electric field in said chamber, said electric field being oriented substantially in a radial direction between said longitudinal axis and said barrier; and a means for injecting said multi-species plasma into said chamber to interact with said magnetic and electric fields for ejecting said high-mass particles into said wall and for confining said low-mass particles in said chamber during transit therethrough to separate said low-mass particles from said high-mass particles.

2. A filter as recited in claim 1 further comprising a means for superimposing an axial magnetic field with said magnetic field established by said helical coils, said axial magnetic field being established in said chamber and aligned substantially parallel to said longitudinal axis.

3. A filter as recited in claim 2 wherein said axis contains a first point having cylindrical coordinates {r, θ, z} equal to {0,0,0} and the magnetic field established in said chamber has components $B_r$, $B_\theta$, and $B_z$ at each coordinate {r, θ, z} in said chamber, wherein:

$$B_r=-ibI_m'[kr]\exp[im\theta+ikz]$$

$$B_{74}=[b/kr]I_m\exp[im\theta+ikz]$$

$$B_z=bI_m\exp[im\theta+ikz]+B_0$$

and wherein $I_m$ is the modified Bessel function, $I_m'$ is the derivative of the modified Bessel function, b is the strength of the helical field and $B_0$ is the uniform axial magnetic field.

4. A filter as recited in claim 3 wherein said electric field established in said chamber has a positive potential on said longitudinal axis of "$V_{ctr}$" and a substantially zero potential on said inner wall, R is the distance between said longitudinal axis and said inner wall, e is the magnitude of the electron charge, the magnitude of $B_0$ is greater than the magnitude of b, and wherein said low-mass particles have a mass less than $M_c$, where $$M_c=e(B_0(B_0-b))R^2/8V_{ctr}.$$

5. A filter as recited in claim 1 wherein said plurality of helically shaped coils comprises four helically shaped coils, each said helically shaped coil being inclined at approximately the same angle of inclination, β.

6. A filter as recited in claim 1 wherein said helically shaped coils are equally spaced around said outer wall at said first end of said barrier.

7. A filter as recited in claim 1 wherein said means for generating said electric field is a series of conducting rings concentrically centered on said longitudinal axis and positioned at one end of said barrier.

8. A filter as recited in claim 1 wherein said means for generating said electric field comprises a spiral electrode.

9. A filter as recited in claim 1 wherein said means for generating said electric field establishes a field in said chamber having a positive potential on said longitudinal axis and a substantially zero potential on said inner wall.

10. A method for separating low-mass particles from high-mass particles in a multi-species plasma which comprises the steps of:

surrounding a chamber with a substantially cylindrically shaped wall, said chamber defining a longitudinal axis, said longitudinal axis containing a first point having cylindrical coordinates {r, θ, z} equal to {0,0,0};

generating a magnetic field in said chamber, said magnetic field having components $B_r$, $B_\theta$and $B_z$ at each coordinate {r, θ, z} in said chamber, wherein $$B_r=-ibI_m'[kr]\exp[im\theta+ikz]$$

$$B_\theta=[b/kr]I_m\exp[im\theta+ikz]$$

$$B_z=bI_m\exp[im\theta+ikz]+B_0$$

and wherein $I_m$ is the modified Bessel function, $I_m'$ is the derivative of the modified Bessel function, b is the strength of the helical field and $B_0$ is the uniform axial magnetic field;

generating an electric field in said chamber, said electric field being oriented substantially in a radial direction between said longitudinal axis and said wall; and injecting said multi-species plasma into said chamber to interact with said magnetic and electric fields for ejecting said high-mass particles into said wall and for confining said low-mass particles in said chamber during transit therethrough to separate said low-mass particles from said high-mass particles.

11. A method as recited in claim 10 wherein said electric field established in said chamber has a positive potential on said longitudinal axis of "$V_{ctr}$" and a substantially zero potential on said wall, R is the distance between said longitudinal axis and said wall, e is the magnitude of the electron charge, the magnitude of $B_0$ is greater than the magnitude of b, and wherein said low-mass particles have a mass less than $M_c$, where $$M_c=e(B_0(B_0-b))R^2/8V_{ctr}.$$

12. A method as recited in claim 11 further comprising the step of varying the magnitude of said helical field, b, to alter $M_c$.

13. A method as recited in claim 11 further comprising the step of varying said positive potential ($V_{ctr}$) of said electric field at said longitudinal axis to alter $M_c$.

14. A method as recited in claim 11 further comprising the step of varying said uniform axial magnetic field, $B_0$ to alter $M_c$.

15. A method as recited in claim 10 wherein said electric and magnetic fields place said high-mass particles onto trajectories rotating about a guiding center that travels on a surface having a hyperbolic shape to eject said high-mass particles into said wall.

16. A method as recited in claim 15 wherein said electric and magnetic fields place said low-mass particles onto trajectories rotating about a guiding center that travels on a surface having an elliptical shape to confine said low-mass particles in said chamber during transit therethrough.

17. A method for separating low-mass particles from high-mass particles in a multi-species plasma which comprises the steps of:

surrounding a chamber with a barrier;

generating an electric field in said chamber;

generating a magnetic field in said chamber; and injecting said multi-species plasma into said chamber to interact with said magnetic and electric fields to place said high-mass particles onto trajectories rotating about a guiding center that travels within a surface having a hyperbolic shape to eject said high-mass particles into said wall, and to place said low-mass particles onto trajectories rotating about a guiding center that travels within a surface having an elliptical shape to confine said low-mass particles in said chamber during transit therethrough.

18. A method as recited in claim 17 wherein said barrier is substantially cylindrically shaped and has a first end, a second end and defines a longitudinal axis, and where said step of generating a magnetic field in said chamber comprises the steps of:

mounting a plurality of helically shaped coils on said wall, each said coil extending from said first end of said barrier to said second end of said barrier; and causing a current to flow through each said helically shaped coil.

19. A method as recited in claim 17 wherein said electric field in said chamber is substantially oriented in a radial direction between said longitudinal axis and said barrier.

20. A method as recited in claim 19 wherein said longitudinal axis contains a first point having cylindrical coordinates {r, θ, z} equal to {0,0,0} and said magnetic field has components $B_r$, $B_\theta$ and $B_z$ at each coordinate {r, θ, z} in said chamber, wherein $$B_r=-ibI_m'[kr]\exp[im\theta+ikz]$$

$$B_\theta=[b/kr]I_m\exp[im\theta+ikz]$$

$$B_z=bI_m\exp[im\theta+ikz]+B_0$$

and wherein $I_m$ is the modified Bessel function, $I_m'$ is the derivative of the modified Bessel function, b is the strength of the helical field and $B_0$ is the uniform axial magnetic field.

21. A method as recited in claim 20 wherein said electric field established in said chamber has a positive potential on said longitudinal axis of "$V_{ctr}$" and a substantially zero potential on said barrier, R is the distance between said longitudinal axis and said barrier, e is the magnitude of the electron charge, the magnitude of $B_0$ is greater than the magnitude of b, and wherein said low-mass particles have a mass less than $M_c$, where $$M_c=e(B_0(B_0-b))R^2/8V_{ctr}.$$

22. A method as recited in claim 18 wherein said multi-species plasma is injected into said chamber at an injection point and said electric field and said magnetic field combine to impart a force on said high-mass particles and said low-mass particles, said force being oriented substantially parallel to said longitudinal axis and in a direction substantially away from said injection point.

* * * * *

UNITED STATES PATENT AND TRADEMARK OFFICE

CERTIFICATE OF CORRECTION

PATENT NO. : 6,541,764 B2
DATED : April 1, 2003
INVENTOR(S) : Tihiro Ohkawa

It is certified that error appears in the above-identified patent and that said Letters Patent is hereby corrected as shown below:

Column 5,
Line 39, delete "a n" insert -- an --
Line 54, delete "FIG. 2," insert -- FIG. 1, --

Column 7,
Line 64, delete "$B_{74}$" insert -- $B_{\theta}$ --

Signed and Sealed this

Nineteenth Day of August, 2003

JAMES E. ROGAN
*Director of the United States Patent and Trademark Office*